United States Patent [19]

Rand, Jr.

[11] Patent Number: 4,593,595

[45] Date of Patent: Jun. 10, 1986

[54] MECHANICAL GUITAR CHORD MAKER

[76] Inventor: David Rand, Jr., 1900 Palm City Rd. Bldg. 25, Stuart, Fla. 33497

[21] Appl. No.: 659,690

[22] Filed: Oct. 11, 1984

[51] Int. Cl.[4] ..... G10D 3/08

[52] U.S. Cl. ..... 84/317

[58] Field of Search ..... 84/315–317

[56] References Cited

U.S. PATENT DOCUMENTS

| | | | |
|---|---|---|---|
| 1,219,884 | 3/1917 | Thingstad | 84/317 |
| 1,553,057 | 9/1925 | Weaver | 84/317 |
| 1,785,311 | 12/1930 | Johnson | 84/317 |
| 2,669,151 | 2/1954 | Maccaferri | 84/317 |
| 4,331,059 | 5/1982 | Marabotto | 84/317 |

*Primary Examiner*—Lawrence R. Franklin

*Attorney, Agent, or Firm*—Wolf, Greenfield & Sacks

[57] ABSTRACT

A chord-playing attachment for guitars and the like has a supporting frame which can be fitted to the neck of the instrument, and one or more chord-selectors removably attached to the frame, for pre-selecting chords to be played by pressing on a button. Chord-selectors can be interchanged on the frame.

10 Claims, 5 Drawing Figures

MECHANICAL GUITAR CHORD MAKER

BACKGROUND OF THE INVENTION

This invention relates to devices for enabling the unskilled, the handicapped, and the untutored, to play string musical instruments of the kind having a fretted neck with a plurality of strings stretched over it. More particularily, the invention provides a chord-playing attachment for such instruments which enables the prior selection of chords to be played.

THE PRIOR ART

The problem of simplifying the making of chords on stringed instruments, such as guitars, which have a fretted neck and a plurality (e.g.: 4, 6, 12) of strings stretched over it, has attracted many proposed solutions. Some approach the challenge from the standpoint of making it easier for the untutored to play guitars and banjos; others address the desires of handicapped persons. The prior art includes several examples of chord playing attachments for fastening onto the neck of a string musical instrument for the purpose of enabling a chord to be elected merely by manually depressing a button or buttons. U.S. Pat. Nos. 1,120,091; 2,132,281; 2,450,210; 2,609,152; 2,746,337; 3,776,088 and 3,915,051 are believed to be representative of the pertinent prior art, all featuring a push-button attached to a breaker (20, in U.S. Pat. No. 2,132,281) fitted with a number of shoes (21) to engage strings to make a chord. The main problem appears to be rigidity (see U.S. Pat. Nos. 3,776,088 and 3,915,051) so as to get clear tones. U.S. Pat. No. 2,746,337 (SMIT) features a complex set of gear-coupled rollers (58, 61) which define specific chords.

GENERAL NATURE OF THE INVENTION

The present invention provides a chord-playing attachment for necked string-instruments of the type described above which is made essentially of two components. An adjustable rigid supporting frame is removably attachable to the neck, and has adjustments and abutments for assuring a rigid fit while being clear of the strings. The frame has rigid bars at the sides of the neck which include sockets for removably receiving a second component which is operable to select a unique chord. Several second components are provided, each for selecting a unique chord, and the frame can hold two or more chord-selector components simultaneously. The invention thus provides, for the first time, a chord-playing attachment for necked string musical instruments which can enable the playing of one or more chords, interchangeably, by the pressing of a button or buttons, one for each chord. Interchanging chords to be played is done simply by removing from the frame one chord-selector (second) component and installing in its place on the frame another chord-selector component which is dedicated to a different chord.

BRIEF DESCRIPTION OF THE DRAWINGS

Other objects and features of the invention will be apparent from the following description of exemplary embodiments with reference to the accompanying drawings, in which.

DETAILED DESCRIPTION OF THE DRAWINGS

Figure 1:
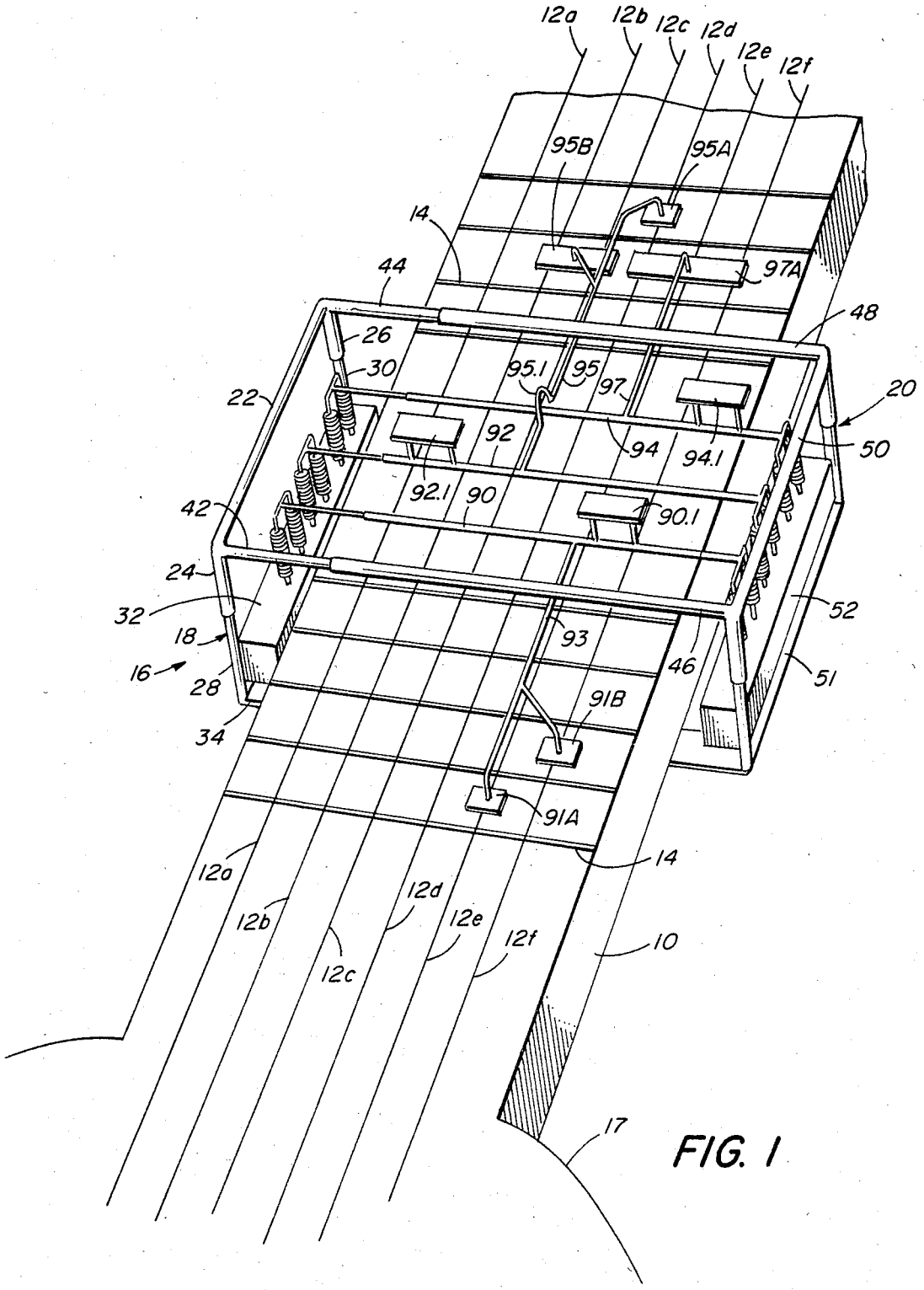
FIG. 1 shows a chord-playing attachment of the invention installed on the neck of a string instrument.

FIG. 1 is a "panoramic" view of the invention as installed on the neck 10 of, for example, a guitar having six strings 12 a–f, inclusive, and a series of frets, 14. A rigid box-like supporting frame 16 (shown alone in detail in FIG. 2) has first and second side parts 18, 20, respectively, each of which is telescopically adjustable in height to the thickness of the neck 10. The first side part 18 which is representative of both has a top portion comprising a rigid top bar 22 (which may be solid or tubular) with two rectangularly-oriented tubular end arms 24, 26, and a bottom portion comprising end rods 28, 30, respectively telescopically fitted into the end arms 24, 26, and a rigid socket bar 32 of preferably rectangular cross section to the ends of which the rods 28, 30 are firmly affixed. Inwardly extending feet 34, 36 fitted to the end rods 28, 30, respectively, are provided to engage the underside of the neck 10. Corresponding feet 35, 37 are provided on the second side part 20, where a connecting stabilizer rod 51 is shown. A similar stablizer rod (not shown) is included on the first side part 18. Inwardly extending top pads 38, 40, respectively, are fixed to the top bar 22, for engaging the upper surface of the neck 10, when the first part 18 is suitably adjusted in height. Corresponding top pads 39, 41, respectively, are fixed to the top bar 50 of the second side part 20. The second side part 20 is similar to the first side part 18, for engaging the opposite side of the neck 10.

Transverse bars 42, 44 extend from the ends of the top bar 22 toward the second side part 20 and transverse tubular members 46, 48 extend from the ends of the top bar 50 of the second side part 20 toward the first side part 18. Each of the transverse bars 42,44 fits telescopically into one of the transverse tubular members 46, 48, respectively, whereby the supporting frame 16 is adjustable to the width of the neck 10. The rigid socket bars 32 (first side 18) and 52 (second side 20) lie alongside the two long sides of the neck 10 when the supporting frame 16 is snugly fitted to the neck 10, and are held substantially rigidly in position relative to the neck when the side parts 18 and 20 are compressed so as to bring the bottom feet 34, 36; 35, 37 and top pads 38, 40; 39, 41 into engagement with the respective lower and upper surfaces of the neck.

Figure 2:
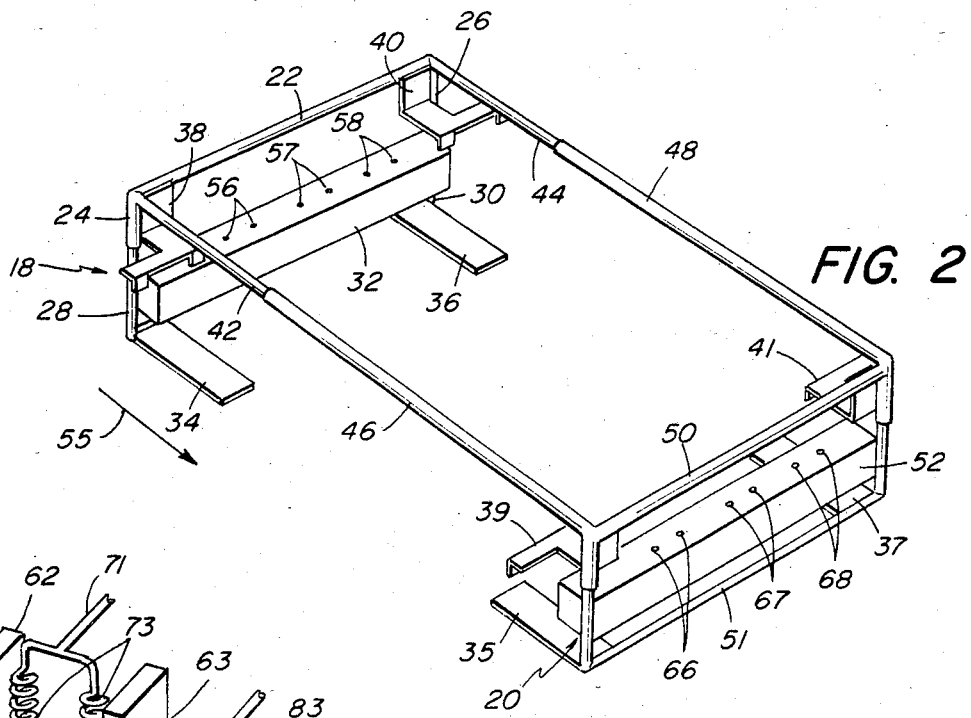
FIG. 2 shows the rigid supporting frame.
Figure 4:
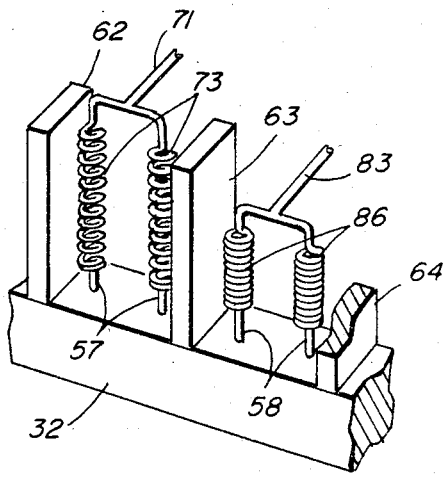
FIG. 4 shows a detail of the socket for mounting chord-selector components.
Figure 5:
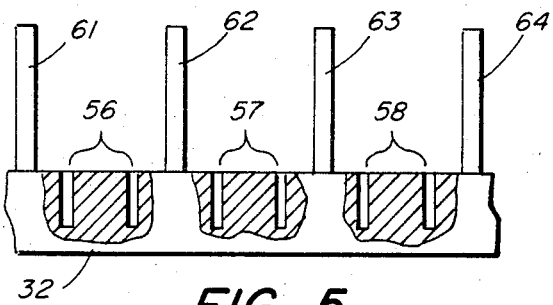
FIG. 5 is an end view of a modified support for chord-selector components.

One of the socket bars 32 is shown partly broken away in FIGS. 4 and 5, the view in these figures looking at the end of the first side part 18 in the direction of the arrow 55 shown in FIG. 2. Each socket bar 32, 52 has three sets of two sockets opening from its top surface, the socket pairs 56, 57, 58 in the first socket bar 32, shown in FIG. 5, being representative. The corresponding socket pairs 66, 67, 68 in the second socket bar 52 are indicated in FIG. 2. If desired, stabilizing plates can be provided, for a purpose to be described, as exemplified by plates 60, 61, 62 and 63 fixed to the top wall of the first socket bar 32, in FIG. 5.

Figure 3:
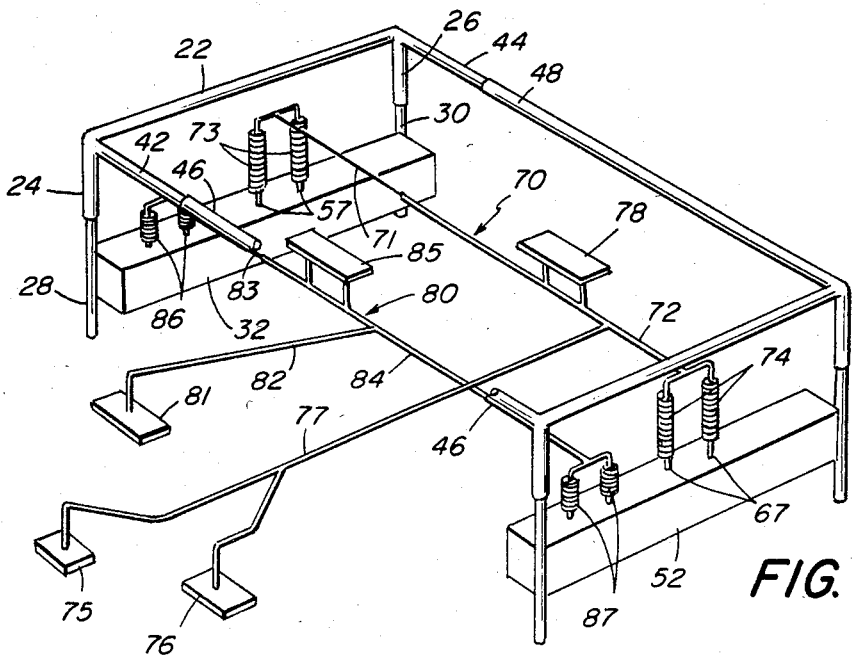
FIG. 3 shows the frame, with certain details omitted, and two chord-selector components fitted to the frame.

A first chord-selector component 70 is shown in FIG. 3, connected at its ends into the intermediate sockets 57 and 67, respectfully. The chord selector component includes a telescopic spanner 71, 72 fitted at its ends with pairs of compressible legs 73, 74, the ends of which, respectively engage in the sockets 57, 67. The spanner parts 71, 72 fit telescopically one inside the other for allowing the length of the spanner to be adjusted relative to the width of the neck 10, so that when the legs 73, 74 are fitted into their respective sockets 57, 67, the spanner will span (i.e.: traverse) the neck above the strings 12*a–f*. Two string-contact pads 75, 76 are fixed to an arm 77 which is fixed at its remote end 78 to the tubular part 72 of the spanner, and extends from the spanner substantially parallel to the strings. A finger pad 78 fixed to the tubular spanner part 72 completes the chord-selector component 70. When the finger pad is pressed to urge the spanner 71, 72 toward the strings, the contact pads press two of the strings to the neck, each pad being located behind one of the frets 14, for selecting a desired string length of each of two preselected strings. As is better shown in FIG. 4, each compressible leg (e.g.: of the pair 73) is in the form of a coiled spring of which the remote end is straight to engage one of the sockets of a pair (e.g.: 57). Stability in the direction toward the neck 10 is enhanced by providing pairs of compressible legs at each end of the spanner. Stability may be further enhanced by additionally providing a pair of stabilizer plates 62, 63 on either side of the legs 73, for example.

A second chord-selector 80 similarily spans the neck 10, being fixed at its ends in the socket pairs 56 and 66, and supporting a string-contact-pad 81 at the end of an arm 82 fixed at its other end to the spanner 83, 84, the tubular part 84 of which carries a finger pad 85. The second chord-selector component 80 is dimensioned for selecting a desired length of a third one of the strings 12*a–f*. The two chord-selectors 70 and 80 shown in FIG. 3 enable the player to operate on three strings, in one case (70) on a pair of strings simultaneously. To enable the first chord-selector component 70 to be pressed toward the strings without pushing down with its arm 77 on the spanner 83, 84 of the second chord-selector component 80, the compressible legs 86, 87 of the second chord-selector component can be made shorter than the compressible legs 73, 74 of the first chord-selector component 70.

Returning now to the "panoramic" view shown in FIG. 1, the frame 16 is shown fitted with three chord-selector components 90, 92, 94, respectively, each having compressible socket-engaging legs of the same or similar length. While stabilizer plates (e.g.: 61–64, inclusive as shown in FIG. 5) are not shown in FIG. 1, it will be understood that they may be included if desired. To simplify the illustration in FIG. 1 such stabilizer plates, as well as the top pads 38, 40; 39, 41 have been omitted from FIG. 1. The first chord-selector component 90 in FIG. 1 has a pair of string contact pads 91A and 91B carried by an arm 93 and disposed to contact strings 12*e* and 12*f*, respectively, each being located behind one of the frets 14 relative to the main body 17 of the instrument.

The arm 93 of the first chord-selector component 90 extends toward the main body. The contact pad carrying arms 95 and 97 of the second and third chord-selector components 92, 94 respectively, extend in the opposite direction, toward the tuning-key end of the neck 10. The contact pad 97A of the third chord-making component 94 is a rectangular pad elongated across the neck 10 so as to contact three strings 12*d*, 12*e* and 12*f* when the corresponding finger pad 94.1 is pressed. The arm 95 of the second chord-making component carries two string-contact pads 95A and 95B, of which 95A is dimensioned and located to contact one string 12*d*, and 95B is dimensioned and located to contact two strings 12*b* and 12*c*, each pad behind a different fret 14, when the corresponding finger pad 92.1 is pressed. To avoid the arm 95 pushing down on the spanner of the third chord-making component 94, the arm 95 has a "jump-over" u-shaped section 95.1 in it where it passes over the spanner of the third chord-making component. Alternatively, shorter legs as shown in FIGS. 3 and 4 could be used at the third chord-selector component 94.

It is contemplated that, to adjust the reach of any of the arms 93, 95, 97 (in FIG. 1), or 77 or 82 (in FIG. 3), the arms carrying the string-contactor pads may be made telescopically adjustable, in the same manner as the spanners 71, 72 or 83, 84, for example. The invention can be made of metal parts, or plastic parts, as may be desired or preferred for each part. The compressible legs, shown as coiled springs, may be made of other resilient materials.

Each chord-selector component of the invention is designed for selecting a prescribed chord when fitted to the frame 16 and operated by pressing its finger pad, to which end the finger pad of each chord-selector component may be labelled with the prescribed chord component that will be selected by that component. In FIG. 3, for example, the finger pad 78 of the first chord-selector component in that figure is labelled "E", indicating that when that finger pad is pressed the E chord will be selected. The second chord-selector 80 may, for example, select the chord D major 7th when the finger pad 85 is pressed, in which case that finger pad may be labelled "D major 7th".

The invention contemplates that a number of chord-selector components may be provided with a single frame 16, so that a player can fit the frame with a set of desired chord-selector components, interchangeably, as desired. This will enable a young child or novice guitar player to be able to play certain chords perfectly by merely placing a device according to this invention on the neck of a guitar, which device, when properly utilized, will automatically form certain guitar chords so that all the player need do, to play a chord, is to press a button with one hand and strum the strings with the other hand.

For a right-handed guitar player, the invention, in effect, becomes the player's left hand. The purpose of the invention is to mechanically hold down the guitar strings behind the correct frets of the guitar (just as a player's left hand fingers would do); thus, each of the affected strings comes into contact with the proper fret thereby shortening the vibrating length of that string. When the string(s) is (are) then strummed by the right hand, the proper tone for each string will made, and the correct chord will be played.

I claim:

1. A chord playing attachment for string musical instruments employing a fretted neck with a plurality of strings stretched over it, comprising:

a supporting frame for removable attachment to said neck, said frame including means for removably receiving a chord-selector component, and a chord-selector component comprising an elongated member adapted to extend transversely across the stringed face of said neck and longitudinally compressible resilient members extending substantially perpendicular from two end-regions of said elongated member adjacent respective sides of said neck for removably mating said chord-selector component to said supporting frame, said resilient members holding said elongated member spaced from said strings while permitting said elongated member to be pressed toward said strings for selecting a chord, and string-contacting means fixed to said elongated member for selecting a prescribed chord when said elongated member is pressed toward said strings.

2. A chord-playing attachment according to claim 1 including means fixed to said frame for guiding said compressible members in respective linear paths when said elongated member is pressed toward said strings.

3. A chord-playing attachment according to claim 1 in which said frame has a plurality of said receiving means, for removably receiving simultaneously a like plurality of said chord-selector components, each for enabling selection of a unique chord, whereby said frame can mate selectively with a plurality of different chord-selector components enabling a user to select in advance a plurality of different chords to play.

4. A chord-playing attachment according to claim 1 in which said frame includes socket means for removably receiving said chord-selector component, and said resilient members include socket-mating means for removably mating said chord-selector component via said socket means to said supporting frame.

5. A chord-playing attachment according to claim 1 in which said frame is adjustable in height and width for fitting same to the height and width, respectively, of said neck.

6. A chord-playing attachment according to claim 5 in which said frame is composed of two side parts each adjustable in height, and means joining said two side parts together adjustably distanced apart for adjustment to said width.

7. A chord-playing attachment according to claim 6 in which each side part has means to embrace in part, respectively, the top and bottom walls of said neck near the sides of said neck.

8. A chord-playing attachment according to claim 6 in which each side part includes a rigid bar which is held by said frame in a fixed position alongside a respective side of said neck, each of said bars having socket means in it for removably receiving a chord-selector component.

9. A chord playing attachment according to claim 8 including means fixed to each of said rigid bars for guiding said compressible members in respective linear paths when said elongated member is pressed toward said strings.

10. A chord playing attachment according to claim 9 in which each of said rigid bars has in it a plurality of said socket means, for removably receiving simultaneously a like plurality of said chord-selector components, each for enabling selection of a unique chord, whereby said frame can mate selectively with a plurality of different chord-selector components enabling a user to select in advance a plurality of different chords to play.

* * * * *

UNITED STATES PATENT AND TRADEMARK OFFICE

CERTIFICATE OF CORRECTION

PATENT NO. : 4,593,595

DATED : June 10, 1986

INVENTOR(S) : David Rand, Jr.

It is certified that error appears in the above-identified patent and that said Letters Patent is hereby corrected as shown below:

The title of the patent should read "MECHANICAL GUITAR CHORD MAKER WITH INTERCHANGEABLE CHORDS".

Signed and Sealed this

Eleventh Day of November, 1986

*Attest:*

DONALD J. QUIGG

*Attesting Officer* *Commissioner of Patents and Trademarks*